US009790846B2

(12) United States Patent
Pirault et al.

(10) Patent No.: US 9,790,846 B2
(45) Date of Patent: Oct. 17, 2017

(54) MULTI-CYLINDER OPPOSED STEPPED PISTON ENGINE

(71) Applicant: OSP Engines Limited, London (GB)

(72) Inventors: Jean-Pierre Pirault, West Sussex (GB); Ali Veshagh, Warwickshire (GB)

(73) Assignee: OSP Engines Limited, London (GB)

( * ) Notice: Subject to any disclaimer, the term of this patent is extended or adjusted under 35 U.S.C. 154(b) by 39 days.

(21) Appl. No.: 14/782,376

(22) PCT Filed: Apr. 4, 2014

(86) PCT No.: PCT/GB2014/051050
§ 371 (c)(1),
(2) Date: Oct. 5, 2015

(87) PCT Pub. No.: WO2014/162142
PCT Pub. Date: Oct. 9, 2014

(65) Prior Publication Data

US 2016/0090900 A1 Mar. 31, 2016

(30) Foreign Application Priority Data

Apr. 5, 2013 (GB) ..... 1306180.9

(51) Int. Cl.
*F02B 75/02* (2006.01)
*F02B 33/14* (2006.01)
(Continued)

(52) U.S. Cl.
CPC ..... *F02B 33/14* (2013.01); *F01B 7/14* (2013.01); *F02B 25/08* (2013.01); *F02B 75/02* (2013.01);
(Continued)

(58) Field of Classification Search
CPC .... F02B 2075/025; F02B 25/08; F02B 25/14; F02B 75/28; F02B 75/002; F02B 75/065; F02M 35/1019
See application file for complete search history.

(56) References Cited

U.S. PATENT DOCUMENTS 2,858,816 A * 11/1958 Prentice ..... F01B 7/14 123/48 B
3,557,761 A * 1/1971 Wenzel, Sr. ..... F01B 7/12 123/53.4
(Continued)

FOREIGN PATENT DOCUMENTS

DE 195 09 740 A1 3/1996
GB 1 464 956 A 2/1977

OTHER PUBLICATIONS

International Search Report for Application No. PCT/GB2014/051050, dated Jun. 25, 2014.
(Continued)

*Primary Examiner* — Hai Huynh
*Assistant Examiner* — Long T Tran
(74) *Attorney, Agent, or Firm* — Marshall, Gernstein & Borun LLP

(57) ABSTRACT

With reference to FIG. 2, the invention relates to an opposed stepped piston two-stroke engine comprising at least a first and a second cylinder, wherein the air piston is a stepped piston providing a first air transfer piston that expands and compresses a first air transfer volume to deliver air from the first air transfer volume to an air transfer system, and the exhaust piston is a stepped piston providing a second air transfer piston that expands and compresses a second air transfer volume to deliver air from the second air transfer volume to the air transfer system, each of the first and second air transfer volumes having an air inlet for receiving air; and wherein the air transfer system provides fluid connection
(Continued)

between the respective first air transfer volume of each cylinder and the air port of another respective cylinder, via respective first air transfer conduits, and fluid connection between the respective second air transfer volume of each cylinder and the air port of the other respective cylinder, via respective second air transfer conduits, wherein the drive system is configured, for each cylinder, to have a predetermined phase angle such that one of the exhaust piston and air piston is driven before the other piston, causing delivery of air from its respective air transfer volume to the air transfer system before delivery of air occurs from the other of the air transfer volumes.

14 Claims, 8 Drawing Sheets

(51) Int. Cl.
*F02B 25/08* (2006.01)
*F01B 7/14* (2006.01)
*F02B 75/28* (2006.01)
*F02B 75/18* (2006.01)

(52) U.S. Cl.
CPC ..... *F02B 75/18* (2013.01); *F02B 75/282* (2013.01); *F02B 2075/025* (2013.01)

(56) References Cited

U.S. PATENT DOCUMENTS 3,847,124 A * 11/1974 Kramer ..... F02B 25/08 123/51 B
5,213,067 A * 5/1993 Kramer ..... F01B 7/14 123/25 A
8,347,833 B2 * 1/2013 Hu ..... F02B 33/22 123/48 R

OTHER PUBLICATIONS

Search Report for Application No. GB1306180.9, dated Feb. 18, 2014.

* cited by examiner

MULTI-CYLINDER OPPOSED STEPPED PISTON ENGINE

This invention relates to opposed piston engines, and to multi-cylinder opposed piston two-stroke (2-stroke) engines that use stepped pistons to provide the air flow for combustion without the necessity for external compressors or scavenge blowers.

With reference to FIG. 1, this shows a common arrangement of an opposed piston engine with pistons 2 and 3, connected to crankshafts 13 and 14, moving in a cylinder 1 to compress and expand the volume 1000 according to a 2-stroke combustion cycle, and supplied with air 12 for combustion from a scavenge blower 6 driven from the engine crankshaft 13 via a belt 25. Scavenge blowers such as 6 are frequently bulky, noisy, relatively inefficient, costly and an encumbrance. This picture presents the background to the proposed invention. It is advantageous to provide an engine in which scavenge blowers are not required.

The following explanations of the terms used in the description are provided with reference to FIG. 1, FIG. 2 and FIG. 3 to help interpretation of this text.

A main journal is a solid of revolution and usually an integral part of the crankshaft and is arranged concentrically on the main axis of a crankshaft and is supported by a bearing in a crankcase.

A crankpin is usually an integral part of a crankshaft which carries and is connected to the connecting rods that are in turn connected to the pistons via a slideable joint called the gudgeon pin. Each engine cylinder usually has a piston, subjected to combustion gas pressure and connected via the gudgeon pin to the "small end" of the connecting rod. The other end of the connecting rod, called the "big-end", connects rotatably with the crankpin.

A crankthrow of a crankshaft is usually an integral part of the crankshaft linking the main journal to the crankpin. There is usually at least one crankthrow connecting with each crankpin.

A crankshaft is usually a single part connecting all crankpins and main journals, the main journals.

A piston is the moving part of a positive displacement volumetric machine that acts on the fluid to displace, compress or expand the fluid. The piston is usually of a male shape which engages in a cylinder of a female shape, the motion of the piston moving the fluid to and from the cylinder via ports or valves.

A power piston operates in the combustion cylinder and compresses and expands the gases in the combustion cylinder as part of the combustion process.

An opposed piston engine or compressor is an engine or compressor in which two power pistons slide in a common cylinder compressing and expanding a common volume of air.

An opposed stepped piston engine is an opposed piston engine or compressor that has at least one air transfer piston.

An opposed cylinder is a cylinder that contains two pistons that move towards and away from each other according to the motion imparted to them by the crankshaft mechanism.

An air transfer piston is a piston used to transfer air from the air intake system to the power piston.

Ports of 2-stroke engines are the apertures in the cylinder walls that enable the flow of gases from or into the cylinder. For example, reference FIG. 1, 10 are the exhaust ports that allow the exhaust to flow from the cylinder, when uncovered by the power piston 3, to the exhaust pipe 11. Air ports 7*a* (FIG. 1) allow fresh air from the engine scavenge pumps to enter the combustion cylinder volume 1000; the ports are opened and closed by the motion of the power piston 2.

The "air" piston is the power piston which controls the opening and closing of the air ports of the combustion cylinder.

The "exhaust" piston is the power piston which controls the opening and closing of the air ports of the combustion cylinder.

The "phase" of a moving part of an engine relates the relative timing of that moving part to other moving parts. The phase angle is usually defined in terms of crankangle difference between the two moving parts. For example, the exhaust piston of an opposed piston engine usually moves with an advance of 20° crankangle versus the air piston; this means that the exhaust piston will reach its inner dead centre position before the air piston reaches its inner dead centre position, i.e. earlier in terms of the engine operating cycle.

"Inner dead centre" (IDC) refers to innermost position of a piston in its travel in the cylinder of an opposed piston engine, i.e. the closest position towards the centre of the cylinder. In engines with cylinder heads, this is normally referred to as "top dead centre".

"Outer dead centre" (ODC) refers to outermost position of a piston in its travel in the cylinder of an opposed piston engine, i.e. the furthest position the centre of the cylinder. In engines with cylinder heads, this is normally referred to as "bottom dead centre".

With opposed piston engines, the air and exhaust pistons approach inner dead centre simultaneously, separated only by the phase angle between the air and exhaust pistons.

An orientation angle is the relative angular position of one part of a component or system to another part of a component or system and in the context of the following description refers to the angle of one complete crankshaft to another adjacent complete crankshaft, or the orientation of one crankpin to another on a crankshaft.

An air duct or conduit is a passageway or connecting route which allows air to be transferred from one point to another.

A 2-stroke cycle is one in which the combustion and gas exchange are arranged to occur once per revolution for each power cylinder. As the combustion, expansion and compression strokes occupy most of the single revolution, a large part of the gas exchange is performed with the aid of a separate air supply, also known as scavenge air, and this air is frequently provided by a scavenge blower.

"Scavenging" air flow of a 2-stroke engine is the frequently used terminology to describe the air flow that passes into a 2-stroke engine, some of which is retained for combustion. The remainder of the air passes through to the exhaust system, removing or scavenging the burned products of combustion, also known as the exhaust products of combustion, from the cylinder.

Scavenging efficiency is a measure of the effectiveness of filling the combustion cylinder volume (1000 in FIG. 1) with clean air.

A scavenge pump or scavenge blower is a compressor or pump 6 (FIG. 1) that provides clean air to purge and fill the combustion volume 1000.

A check valve is a flow control mechanism that allows flow in one direction and prevents flow in the reverse direction. The mechanism is usually a simple leaf-spring flap, located in a conduit, that opens in one direction and closes against an abutment in the reverse direction.

The opening pressure of a check valve is the flow pressure required to enable flow in one direction.

The compression ratio of a cylinder volume with a piston that moves from an innermost to outer most position within the cylinder volume is the ratio of total cylinder volume with the piston at its outermost position divided by the cylinder volume with the piston at its innermost position.

A double diameter, also known as stepped, piston is a piston with two diameters, each of which separately engages one of two female cylinders, the diameters of said cylinders lying on a common axis. The two piston diameters are usually rigidly connected, with the smaller diameter piston being the power piston and the larger diameter being the air transfer piston.

A stepped cylinder comprises a first cylinder which has a first diameter for a first length and which is joined to a second cylinder which has a second diameter for a second length, the axes of first and second cylinders being common.

The forward side of an air transfer piston is the side of the larger diameter of the stepped piston which acts in-phase with the air piston or an exhaust piston.

The stepped piston and the stepped cylinder may be part of either a compressor or an engine.

Cross-over is an expression signifying the transfer of air for combustion from one cylinder of an engine to another cylinder of the same engine.

A cross-over port is a flow conduit system or assembly enabling fluid transfer firstly from a first cylinder to a second cylinder, and secondly fluid transfer from a second cylinder to a first cylinder.

A cross-over scavenge system is a reciprocal arrangement of scavenge pumps and airflow conduits and check valves that enable one cylinder to provide the air required by another, and vice-versa.

A cylinder "bank" or cylinder "barrel" is a block of metal that contains the cylinder bores of an engine.

An "in-line" engine has its cylinders arranged in a single linear cylinder row.

A "vee" engine has its cylinders arranged in two cylinder banks in which the connecting rods and pistons are connected by a common crankshaft are located at the junction of the vee, so that some cylinders are arranged in the first bank, whilst the remaining are arranged in the second bank. The angle between the cylinder banks of a vee form engine is usually greater than 45°.

A "narrow vee" engine has its cylinders arranged as a vee engine with the angle between the cylinder banks usually less than 45°.

A "square" engine has its cylinders arranged in two parallel and adjacent cylinder banks with each bank having its own crankshaft connected only to the pistons and connecting rods of that bank, said crankshafts being rotatably linked by some means such as gears, chains or belts. Some of the cylinders are arranged in the first bank, whilst the remaining are arranged in the second bank.

The firing order of an engine is the sequence in which the cylinders operate to generate power and is frequently denoted by simply listing the cylinder numbers in order of firing, e.g. 1-2-3 could be the firing order for a 3 cylinder engine in which the cylinders are arranged in-line, numbering the cylinders 1, 2 and 3 from front of the engine to the rear of the engine.

"Even" firing of cylinders denotes a firing order of cylinders with equal time or crankangle increments between the firing of individual cylinders.

An eccentric rod drive transmits torque from a first rotating shaft to a second rotating shaft and maintains a notionally fixed phase angle between the first and second rotating shafts, the system comprising at least one eccentric fitted rigidly to the first shaft, said first eccentric slidably moving in the first eyelet of a connecting rod, said connecting rod having a second eyelet which slidably engages a second eccentric fitted rigidly to the second shaft. In some cases, pairs of eccentric rods are used with an orientation angle between the eccentrics of the first connecting rod and the eccentrics of the second connecting rod.

The broad concept of the engine includes the provision of at least two cylinders equipped with opposed pistons in which at least one piston of a first cylinder is arranged as a first stepped piston in a first stepped cylinder to provide some or all of the engine airflow requirements for a second cylinder, and one piston of said second cylinder is arranged as another first stepped piston in said second stepped cylinder to provide some or all of the engine airflow requirements for said first cylinder.

According to an aspect of the invention we provide an opposed stepped piston two-stroke engine comprising at least a first and a second cylinder, each cylinder providing:

- an air port for intake of air into a combustion volume within the cylinder, an exhaust port for exhausting gases from the combustion volume,
- an air piston and an exhaust piston which are adapted to compress and expand the combustion volume by each moving between respective compression and expansion positions, such that the air piston controls the air port and the exhaust piston controls the exhaust port by opening and closing the respective ports,
- a drive system operable to drive the air piston and exhaust piston between their respective compression and expansion positions, the drive system comprising a pair of crankshafts configured to drive the air piston and exhaust piston at a predetermined phase angle relative to one another,
- a fuelling assembly for providing fuel to the combustion volume, and
- an ignition assembly for providing ignition within the combustion volume;
- wherein the air piston is a stepped piston providing a first air transfer piston that expands and compresses a first air transfer volume to deliver air from the first air transfer volume to an air transfer system, and the exhaust piston is a stepped piston providing a second air transfer piston that expands and compresses a second air transfer volume to deliver air from the second air transfer volume to the air transfer system, each of the first and second air transfer volumes having an air inlet for receiving air;
- and wherein the air transfer system provides:
  - fluid connection between the respective first air transfer volume of each cylinder and the air port of another respective cylinder, via respective first air transfer conduits, and
  - fluid connection between the respective second air transfer volume of each cylinder and the air port of the other respective cylinder, via respective second air transfer conduits,
- wherein the drive system is configured, for each cylinder, to have a predetermined phase angle such that one of the exhaust piston and air piston is driven before the other piston, causing delivery of air from its respective air transfer volume to the air transfer system before delivery of air occurs from the other of the air transfer volumes.

Further features of the above aspects of the invention are described in the appended claims.

Embodiments of the invention will now be described, by way of example only, with reference to the following figures, of which:

Figure 1:
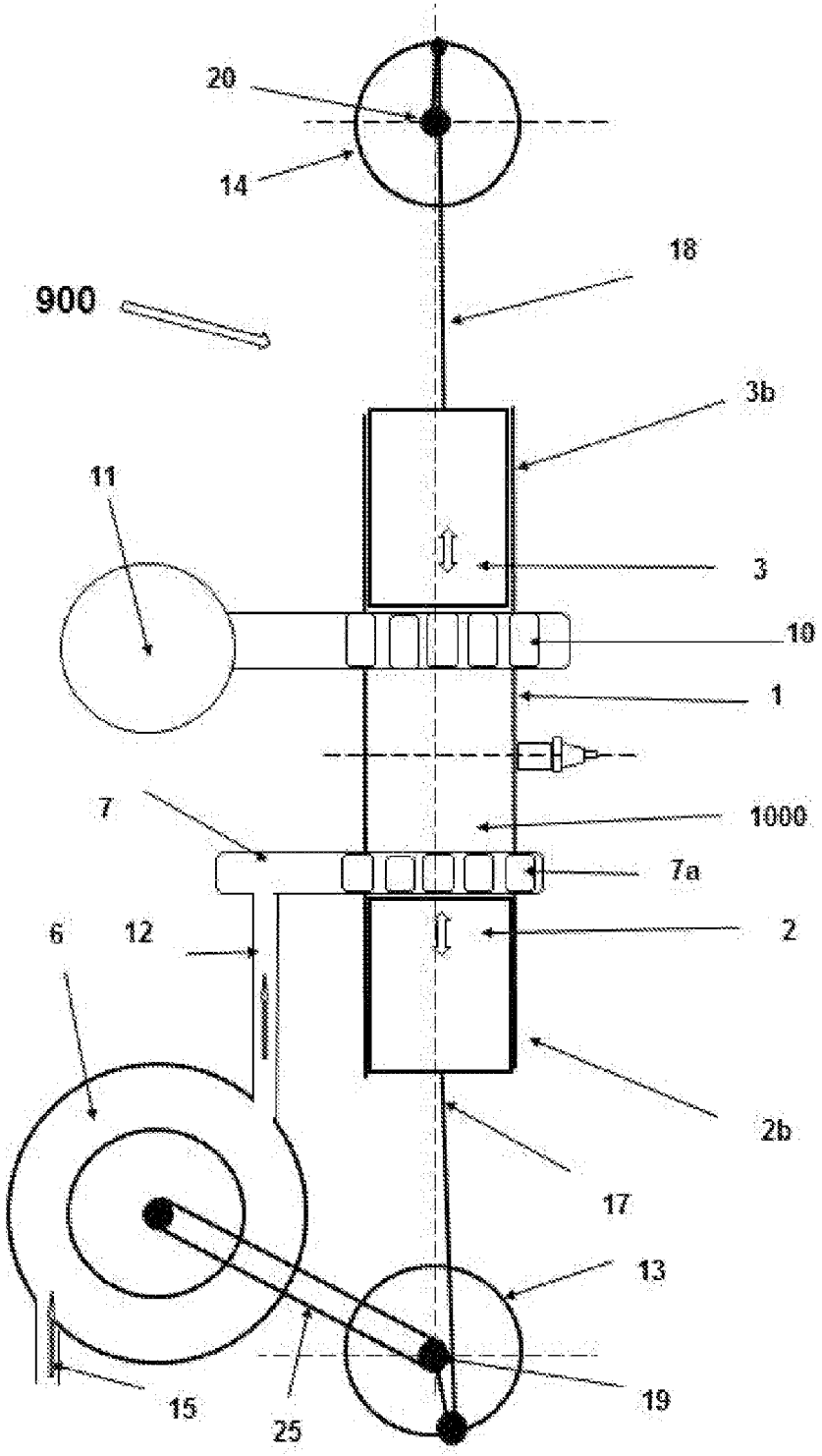
FIG. 1 shows an end view of the general diagrammatic arrangement of a single cylinder opposed piston engine of the prior art, with an external scavenge air compressor, also known as a scavenge blower.
Figure 2:
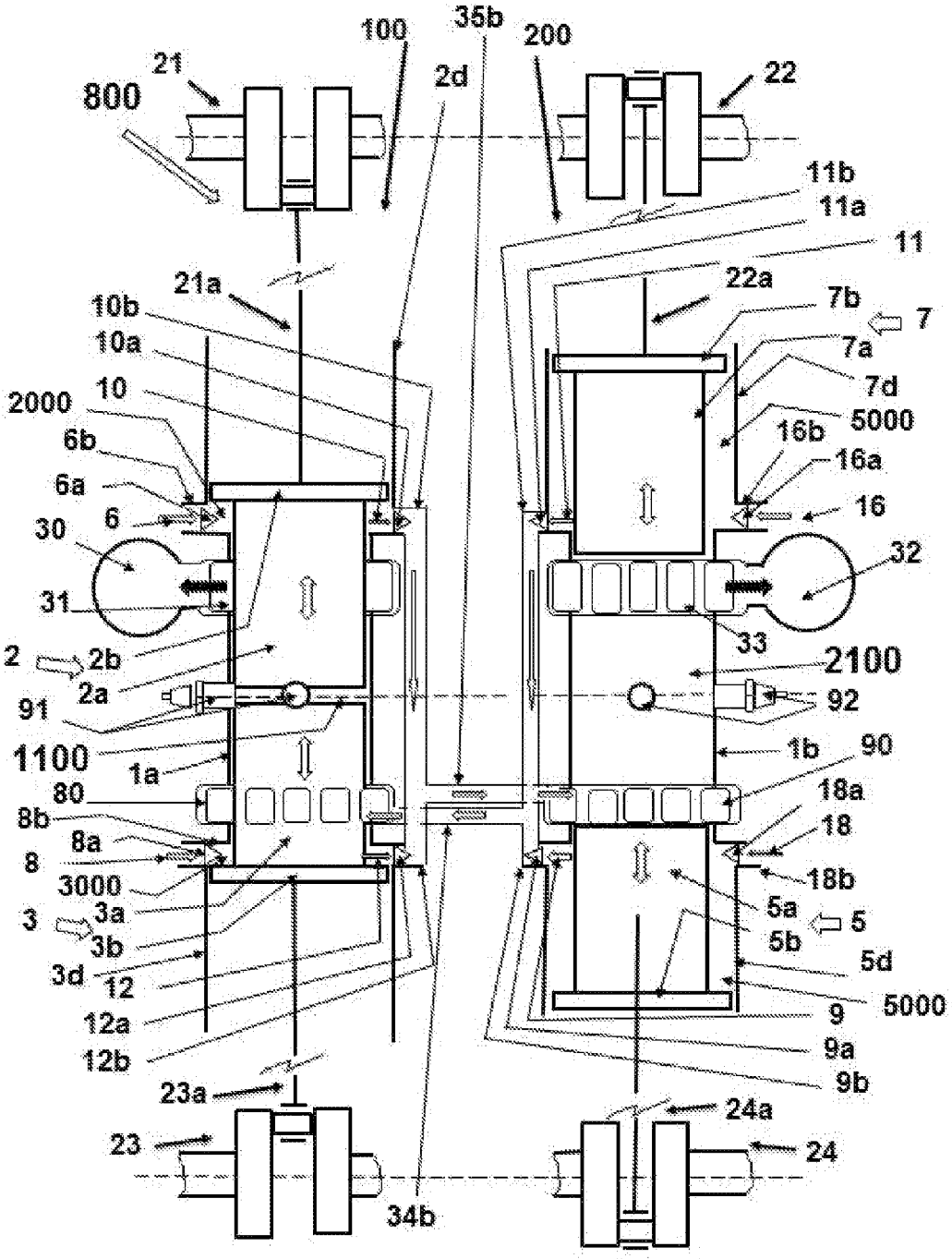
FIG. 2 shows a first side view of a simplified diagrammatic arrangement of a first embodiment of a two cylinder opposed piston engine 800 with stepped pistons and a cross-over scavenge system with the stepped pistons in a first position.

In embodiments, with reference to FIG. 2 of the invention, we provide an opposed piston engine 800 with a first cylinder 100 and a second cylinder 200 in which stepped pistons 2, 3, 5 and 7 are driven respectively by connecting rods 21*a*, 23*a*, 24*a* and 22*a* linked to crankshafts 21, 23, 24 and 22. In this way the pistons 2 and 3 slide in a cylinder 1*a* to compress and expand the volume 1100 according to a 2-stroke combustion cycle, and so that the pistons 5 and 7 slide in a cylinder 1*b* to compress and expand the volume 2100 according to a 2-stroke combustion cycle.

The volume 1100 defined between the working faces of power pistons such as the exhaust piston 2 and air piston 3 will be referred to herein as the combustion volume.

In broad terms, the engine has at least a first 100 and a second cylinder 200, each cylinder providing an air port 80, 90 for intake of air into a combustion volume 1100, 2100 within the cylinder, an exhaust port 30, 32 for exhausting gases from the combustion volume 1100, 2100, and an air piston 3, 5 and an exhaust piston 2, 7 which are adapted to compress and expand the combustion volume 1100, 2100 by each moving between respective compression and expansion positions. In this manner the air piston 3, 5 controls the air port 80, 90 and the exhaust piston 2, 7 controls the exhaust port 30, 32 by opening and closing the respective ports.

A drive system is operable to drive the air piston 3, 5 and exhaust piston 2, 7 between their respective compression and expansion positions. The drive system comprises a pair of crankshafts 21, 22, 23, 24 configured to drive the air piston 3, 5 and exhaust piston 2, 7 at a predetermined phase angle relative to one another, as described in greater detail below.

The engine further includes a fuelling assembly for providing fuel to the combustion volume, and an ignition assembly for providing ignition within the combustion volume 1100, 2100.

The air piston 3, 5 is a stepped piston providing a first air transfer piston 3*b*, 5*b* that expands and compresses a first air transfer volume 3000, 5000 to deliver air from the first air transfer volume 3000, 5000 to an air transfer system. Similarly, the exhaust piston 2, 7 is a stepped piston providing a second air transfer piston 2*b*, 7*b* that expands and compresses a second air transfer volume 2000, 7000 to deliver air from the second air transfer volume 2000, 7000 to the air transfer system. Each of the first and second air transfer volumes having an air inlet for receiving air 6, 8, so that air is drawn into the respective volume as it expands.

Figure 3:
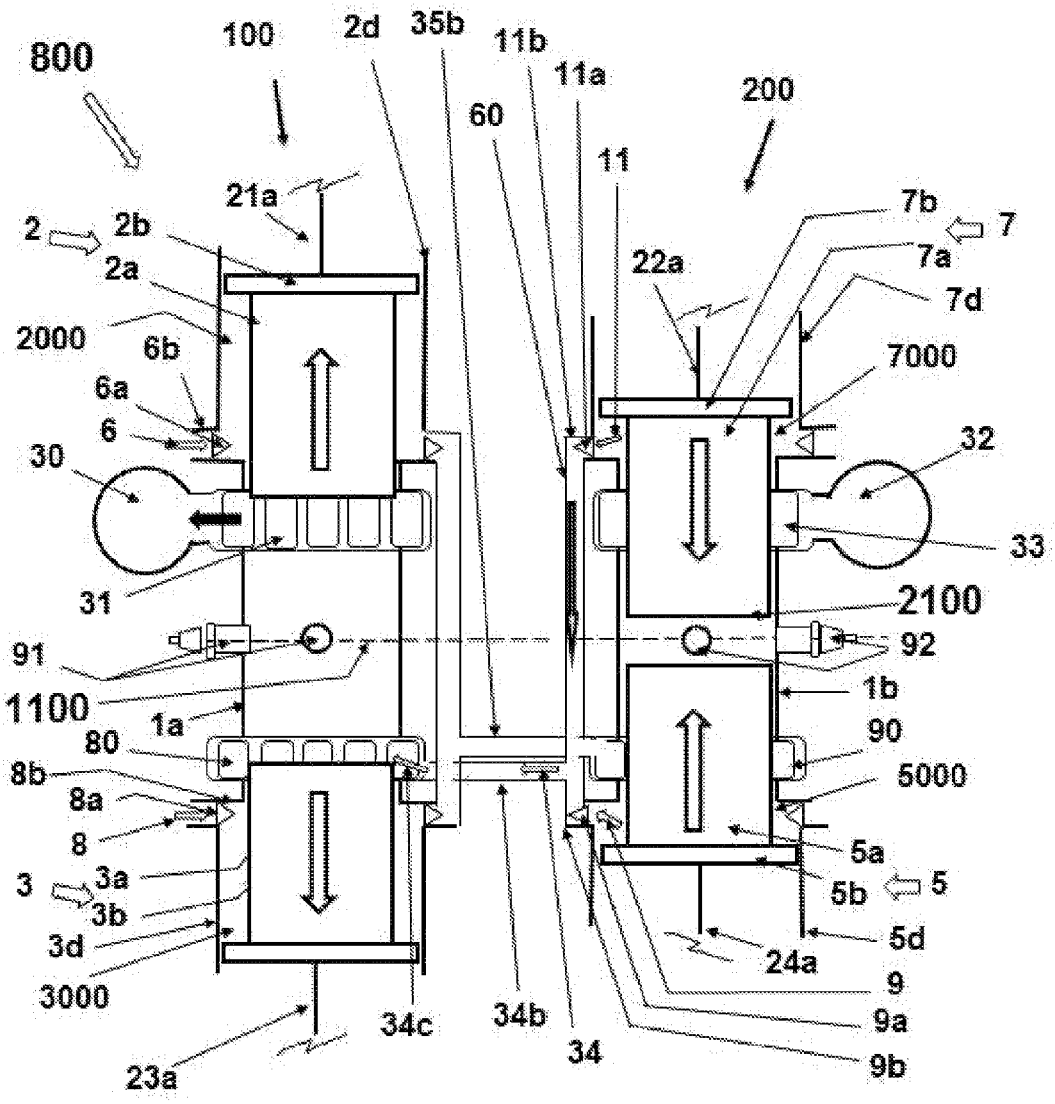
FIG. 3 shows a second side view of a simplified diagrammatic arrangement of the first embodiment of a single cylinder opposed piston engine 800.

In general terms, the air transfer system includes passages that provide fluid connection between the respective first air transfer volume 3000, 5000 of each cylinder and the air port 80, 90 of another respective cylinder, via respective first air transfer conduits. In embodiments, and as shown in FIGS. 2 and 3, for example, the other respective cylinder is the second of the two cylinders. In other embodiments, and as described below, further cylinders may be comprised by the engine, such that the air transfer systems may be provided in a series between consecutive cylinders.

In a similar way, the air transfer system also provides connections between the respective second air transfer volume 2000, 7000 of each cylinder 100, 200 and the air port of the other respective cylinder 89, 90, via respective second air transfer conduits.

The drive system is configured, for each cylinder 100, 200, to have a predetermined phase angle such that the exhaust piston 2, 7 is driven towards its combustion position (i.e. it begins to move) before the air piston 3, 5 begins to move towards its combustion position. The length of the passage forming the second air transfer conduit is longer than the length of passage forming the first air transfer conduit, so that as the exhaust piston 2, 7 moves towards its combustion position causing the second air transfer volume 2000, 7000 to be compressed, air is delivered from the second air transfer volume 2000, 7000 to the air transfer system, prior to movement of the air piston 3, 5 towards its combustion position causing the first air transfer volume 3000, 5000 to be compressed and air to be delivered from the first air transfer volume 3000, 5000 to the air transfer system.

Of course, it should be understood that the length of the conduits, and the phasing of the relative pistons could be reversed, so that the length of passage forming from the first air transfer conduit is longer, and the air piston moves before the exhaust piston. In general, one of the exhaust piston and air piston is driven before the other piston, causing delivery of air from its respective air transfer volume to the air transfer system before delivery of air occurs from the other of the air transfer volumes.

With reference to the drawings, in embodiments, cylinders 100 and 200 are phased by 180° crankangle so that pistons 2 and 3 move towards each other from their ODC to their IDC as pistons 5 and 7 move apart from each other from their IDC to their ODC positions. The scavenge air for cylinder volume 1100 of cylinder 100 is supplied by stepped scavenge pistons 5*b* and 7*b* via the cross-over conduit 34*b* to the transfer ports 80. The scavenge air for cylinder volume 2100 of cylinder 200 is supplied by stepped scavenge pistons 2*b* and 3*b* via the cross-over conduit 35*b* to the transfer ports 90. The scavenge pistons 5*b* and 7*b* receive their respective airflows 18 and 16 via conduits 18*b* and 16*b* and deliver their airflows 9 and 11 via conduits 9*b* and 11 *b* to cross-over conduit 34*b* which is in connection with the scavenge ports 80 of cylinder volume 1100. Check valves 18*a* and 16*a* may be used to control the respective airflows 18 and 16 to stepped piston air transfer volumes 5000 and 7000 respectively without reverse flow, and check valves 9*a* and 11*a* may be used to control the respective airflows 18 and 16 from stepped piston air transfer volumes 5000 and 7000 respectively without reverse flow to the conduits 9*b* and 11 *b*. The scavenge pistons 2*b* and 3*b* receive their respective airflows 6 and 8 via conduits 6*b* and 8*b* and deliver their airflows 10 and 12 via conduits 10*b* and 12*b* to cross-over conduit 35*b* which is in connection with the scavenge ports 90 of cylinder volume 2100. Check valves 6*a* and 8*a* may be used to control the respective airflows 6 and 8 to stepped piston air transfer volumes 2000 and 3000 respectively without reverse flow, and check valves 10*a* and 12*a* may be used to control the respective airflows 10 and 12 from stepped piston air transfer volumes 2000 and 3000 respectively without reverse flow to the conduits 10*b* and 12*b*.

The exhaust ports 31 in the cylinder liner 1*a* of cylinder 100 are controlled by of the displacement of the exhaust power piston 2*a*, as controlled by the crankshaft 21, such that the exhaust ports are fully open when the piston 2*a* is at its outer dead centre position, and are fully closed when the piston 2*a* fully covers the exhaust ports 31 as the piston 2*a* moves towards its inner dead centre position. The exhaust ports are connected by conduits to the exhaust receiver 30.

The air transfer ports 80 in the cylinder liner 1*a* are controlled by of the displacement of the air power piston 3*a*, as controlled by the crankshaft 23, such that the air transfer ports 80 are fully open when the piston 3*a* is at its outer dead centre position, and are fully closed when the piston 3*a* fully covers the air transfer ports 80 as the piston 3*a* moves towards its inner dead centre position.

Piston 2 is a stepped piston with a larger diameter 2*b* that is a first air transfer piston acting on air volume 2000 and moving in phase with the smaller diameter exhaust power piston 2*a*. The piston elements 2*a* and 2*b* of the piston 2 may be rigidly linked or articulated relative to each other. The skirt of piston 2*a* slides in the cylinder bore 1*a* whilst the skirt of piston 2*b* slides in the cylinder bore 2*d*.

Piston 3 is a stepped piston with a larger diameter 3*b* that is a second air transfer piston acting on air volume 3000 and moving in phase with the smaller diameter air power piston 3*a*. The piston elements 3*a* and 3*b* of the piston 3 may be rigidly linked or articulated relative to each other. The skirt of piston 3*a* slides in the cylinder bore 1*a* whilst the skirt of piston 3*b* slides in the cylinder bore 3*d*.

The exhaust ports 33 in the cylinder liner 1*b* of cylinder 200 are controlled by of the displacement of the exhaust power piston 7*a*, as controlled by the crankshaft 22, such that the exhaust ports are fully open when the piston 7*a* is at its outer dead centre position, and are fully closed when the piston 7*a* fully covers the exhaust ports 33. The exhaust ports are connected by conduits to the exhaust receiver 32.

The air transfer ports 90 in the cylinder liner 1*b* are controlled by of the displacement of the air power piston 5*a*, as controlled by the crankshaft 24, such that the air transfer ports 90 are fully open when the piston 5*a* is at its outer dead centre position, and are fully closed when the piston 5*a* fully covers the air transfer ports 90 as the piston 5*a* moves towards its inner dead centre position.

Piston 5 is a stepped piston with a larger diameter 5*b* that is another first air transfer piston acting on air volume 5000 and moving in phase with the smaller diameter air power piston 5*a*. The piston elements 5*a* and 5*b* of the piston 5 may be rigidly linked or articulated relative to each other. The skirt of piston 5*a* slides in the cylinder bore 1*b* whilst the skirt of piston 5*b* slides in the cylinder bore 5*d*.

Piston 7 is a stepped piston with a larger diameter 7*b* that is another second air transfer piston acting on air volume 7000 and moving in phase with the smaller diameter air power piston 7*a*. The piston elements 7*a* and 7*b* of the piston 7 may be rigidly linked or articulated relative to each other. The skirt of piston 7*a* slides in the cylinder bore 1*b* whilst the skirt of piston 7*b* slides in the cylinder bore 7*d*.

The crankshafts 21 and 23 are linked together by suitable means such as gears or tooth belts, chain drives or eccentric rod drives so that the pistons 2 and 3 move substantially in-phase towards the IDC and ODC of cylinder 100, and may also move with a small degree of out-of-phase so that pistons 2 and 3 arrive at their IDC and ODC positions with a small degree of out of phase. For instance, exhaust power piston 2 can be arranged to arrive at its IDC and ODC positions with an advance of 10-50° crankangle overair power piston 3.

The crankshafts 22 and 24 are linked together by suitable means such as gears or tooth belts, chain drives or eccentric rod drives (not shown in Figures) so that the pistons 7 and 5 move substantially in-phase towards the IDC and ODC of cylinder 200, and may also move with a small degree of out-of-phase so that pistons 7 and 5 arrive at their IDC and ODC positions with a small degree of out of phase. For instance, exhaust power piston 7 can be arranged to arrive at its IDC and ODC positions with an advance of 10-50° crankangle over air power piston 5.

For convenience and simplicity, crankshafts 21 and 22 may be rigidly joined with an orientation angle of 180°, and separately crankshafts 23 and 24 may be rigidly joined with an orientation angle of 180°, so that it is only necessary to have one set of linking means such as gears or tooth belts between and the unified crankshafts 21/22 and the unified crankshafts 23/24.

The linking connecting rods 21*a*, 23*a*, 24*a* and 22*a* between the respective crankshafts 21, 23, 24 and 22 and the respective pistons 2, 3, 5 and 7 are shown truncated for convenience.

Cylinder 100 has means for fuelling and ignition at locations such as 91 in the cylinder wall 1*a*, and cylinder 200 has means for fuelling and ignition at locations such as 92 in the cylinder wall 1*b*.

According to the description of FIG. 2, volume 1100 of cylinder 100 of an engine 800 may receive air from the stepped pistons 5 and 7 of cylinder 200 of the engine 800 via cross-over conduit 34*b* to air ports 80 that form a first part of a cross-over system, and volume 2100 of cylinder 200 of an engine 800 may receive air from the stepped pistons 2 and 3 of cylinder 100 of the engine 800 via cross-over conduit 35*b* to air ports 90 that form a second part of a cross-over system. In short, this may be called a multi-cylinder opposed piston engine with a cross-over stepped piston scavenge or air transfer system. The term cross-over is used as the conduits for air transfer cross from one cylinder to another and vice-versa.

In summary, referencing the first Figure, the invention in a first embodiment is an opposed piston engine 800 with at least two power cylinders in 100 and 200 in which at least a first air transfer piston 2*b* of a first power cylinder 100 is arranged as a stepped piston 2 in a first stepped cylinder bore 2*d* to provide some or all of the engine airflow requirements for a second power cylinder 200 and, in which the forward side of the stepped air transfer piston 2*b* of power cylinder 100 is substantially 180° crankangle out of phase with pistons 5 and 7 of the connecting power cylinder 200, and in which at least a second air transfer piston 7*b* of a second power cylinder 200 is arranged as a stepped piston 7 in a second stepped cylinder bore 7*d* to provide some or all of the engine airflow requirements for a first power cylinder 100, in which the forward side of the stepped air transfer piston 7*b* of power cylinder 200 is substantially 180° crankangle out of phase with pistons 2 and 3 of the connecting power cylinder 100.

In a second embodiment, the invention is an opposed piston engine 800 with at least two power cylinders in 100 and 200 in which a second air transfer piston 3*b* of a first power cylinder 100 is arranged as a stepped piston 3 in a second stepped cylinder bore 3*d* to provide some or all of the engine airflow requirements for a second power cylinder 200 and, in which the forward side of the stepped air transfer piston 3*b* of power cylinder 100 is substantially 180° crankangle out of phase with pistons 5 and 7 of the connecting power cylinder 200, and in which another second air transfer piston 5*b* of a second power cylinder 200 is arranged as a stepped piston 5 in a second stepped cylinder bore 5*d* to provide some or all of the engine airflow requirements for a first power cylinder 100, in which the forward side of the stepped air transfer piston 5*b* of power cylinder 200 is substantially 180° crankangle out of phase with pistons 2 and 3 of the connecting power cylinder 100.

In a third embodiment, the invention is an opposed piston engine 800 with at least two power cylinders in 100 and 200 in which a first air transfer piston 2*b* of a first power cylinder 100 is arranged as a stepped piston 2 in a first stepped cylinder bore 2*d* in combination with a second air transfer piston 3*b* of a first power cylinder 100, also arranged as a stepped piston 3 in a second stepped cylinder bore 3*d* to provide some or all of the engine airflow requirements for a second power cylinder 200 and, in which the forward sides of the stepped air transfer pistons 2*b* and 3*b* of power cylinder 100 are substantially 180° crankangle out of phase with pistons 5 and 7 of the connecting power cylinder 200, and in which another first air transfer piston 5*b* of a second power cylinder 200 is arranged as a stepped piston 5 in a second stepped cylinder bore 5*d* in combination with a second air transfer piston 7*b* of the second power cylinder 200, also arranged as a stepped piston 7 in a another second stepped cylinder bore 7*d*, to provide some or all of the engine airflow requirements for a first power cylinder 100, in which the forward side of the stepped air transfer pistons 5*b* and 7*b* of power cylinder 200 is substantially 180° crankangle out of phase with pistons 2 and 3 of the connecting power cylinder 100.

In a further embodiment, the opposed piston engine 800 with at least at least two power cylinders 100 and 200 as described in the first, second and third embodiments, has the crankshafts 21 and 22 phased to be in advance of the crankshafts 23 and 24 so the exhaust power pistons 2 and 7 arrive at their IDC and ODC in advance of the air power pistons 3 and 5, the typical advance phasing being 10-50° crankangle.

With reference to FIG. 3, this is notionally the same as FIG. 2 but the crankshafts, 21, 22, 23 and 24 are not shown, and some numbering is removed to simplify the picture. FIG. 3 depicts pistons 2 and 3 moving towards their ODC positions, with the exhaust ports 31 and air ports 80 increasing in area. Volume 2000, formed by the displacement of the stepped piston 2*a*/2*b* in the cylinder bore 2*d*, and volume 3000, formed by the displacement of the stepped piston 3*a*/3*b* in the cylinder bore 3*d* are both increasing and therefore sucking air from the atmosphere via the engine induction system into intake pipes 6*b* and 8*b* respectively, the said air then filling volumes 2000 and 3000. So, in FIG. 3, the stepped pistons and cylinders of cylinder 100 are engaged in recharging their air transfer volumes 2000 and 3000. Meanwhile, pistons 5 and 7 of cylinder 200 are moving towards their IDC positions, with the exhaust ports 33 and air ports 90 fully closed. Volume 5000, formed by the displacement of the stepped piston 5*a*/5*b* in the cylinder bore 5*d*, and volume 7000, formed by the displacement of the stepped piston 7*a*/7*b* in the cylinder bore 7*d*, are both decreasing and therefore displacing air 9 and 11 into the flow conduits 9*b* and 11 *b* respectively via the check valves 9*a* and 11*a*. The said air 9 and 11 collects in conduit 60, which is one part of the cross-over system, and then passes as a combined airflow 34 via the cross-over conduit 34*b*, which is another part of the cross-over system, to the airports 80 in the cylinder liner 1*a* of cylinder 100, thereby displacing the burned gases from the previous combustion cycle in cylinder volume 1100 and to providing fresh air for the next combustion event in the volume 1100 of cylinder 100. In this way, the stepped piston scavenge pump volumes 5000 and 7000 formed by the stepped pistons 5 and 7 of cylinder 200 provide the air 34*c* to scavenge and replenish the volume 1100 of cylinder 100. Conduits 60 and 34*b* form part of the "cross-over" air transfer system, also known as the "cross-over ports" of engine 800.

Figure 4:
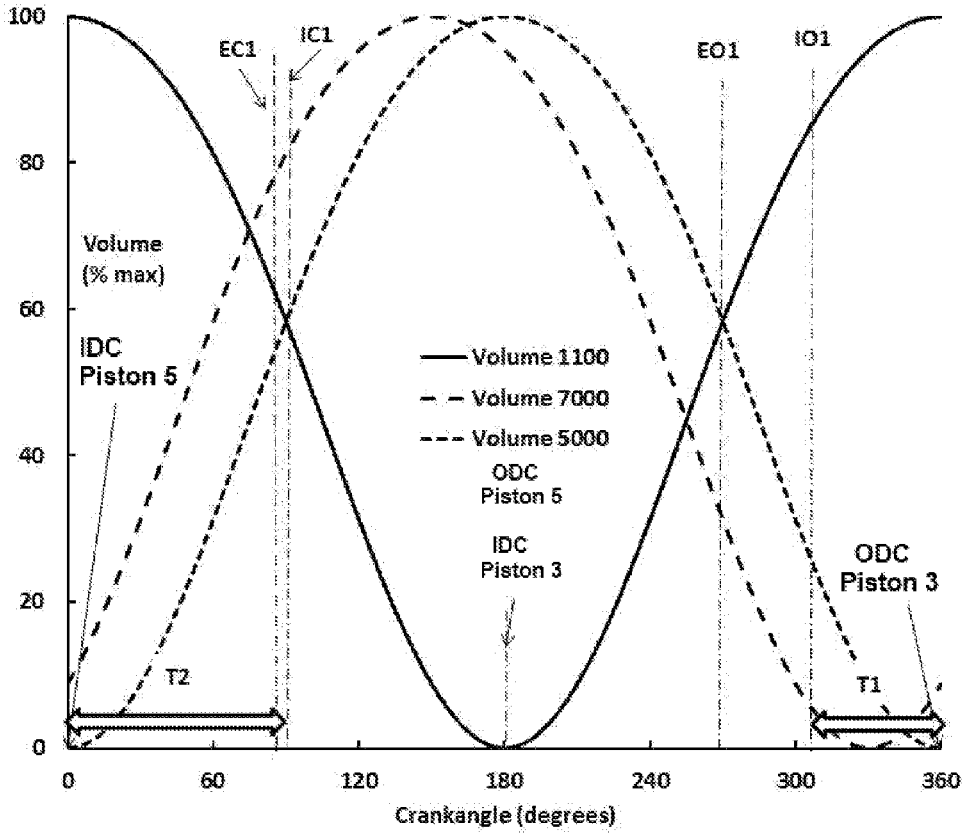
FIG. 4 is a diagram showing the approximate relative phases of the volume changes in the air transfer cylinder volumes and in the combustion cylinder volume of the engine depicted in and FIG. 3.

With reference to FIG. 4, the relative phasing of the volume changes for the cylinder volume 1000 of cylinder 100, the stepped piston air transfer volume 5000 and stepped piston air transfer volume 7000 of cylinder 200 are shown versus the crankangle position of air piston 5, which is phased notionally 30° crankangle in retard of the exhaust piston 7. The exhaust port open period for cylinder 100 corresponds to the crankangle between EO1-EC1, i.e. approximately 160° crankangle duration. The airport open period for cylinder 100 corresponds to the crankangle between IO1-IC1, i.e. approximately 100° crankangle duration denoted by T1 and T2 in FIG. 4. It should be understood that piston 3 and piston 2 of cylinder 100 are phased 180° crankangle relative to piston 5 and piston 7 of cylinder 200, and this is why the ODC of piston 3 corresponds to the IDC of piston 5 and this is why the port timings EO1, EC1, IO1 and IC1, that relate to pistons 2 and 3 of cylinder 100 and volume 1100, are shown either side of the ODC of piston 3. The asymmetry of the port timings is an optional beneficial feature of opposed piston engines, and opposed stepped piston engines, and arises from the phasing of the exhaust and air pistons which in this example is notionally 30° crankangle, as previously stated. The graphs in FIG. 4 show stepped piston air transfer volumes 5000 and 7000 of cylinder 200 move in anti-phase with volume 1100 of cylinder 100 due to 180° crankangle phasing between cylinder 100 and cylinder 200. Hence volumes 5000 and 7000 are being displaced in to volume 1100 as the pistons 2 and 3 of cylinder 100 move towards their outer dead centre (FIG. 3, and ODC in FIG. 4) positions. This air transfer from the volumes 5000 and 7000 of cylinder 200 to the volume 1100 of cylinder 100 occurs during the expansion stroke of the cylinder 100 as the air ports open (IO1 in FIG. 4) after the opening of the exhaust ports (EO1 in FIG. 4), and continues to outer dead centre of pistons 2 and 3. In this way, the volume 1100 of cylinder 100 is positively scavenged with fresh air from the opening to closing of the air ports. It should be explained that in FIG. 4 the volume displacements 1100, 5000 and 7000 are all shown as having maximums of 100% notionally for simplicity and clarity. However, the absolute volumes 1100, 5000 and 7000 can all be different and adjusted by design of the selected diameters of the pistons 2 and 3 and pistons 5 and 7, and the strokes of crankshafts 21, 22, 23 and 24. The air transfer flowrates can be regulated by and the positions of the air entry ports 18*b* and 16*b* of the volumes 5000 and 7000 respectively, relative to the moving surfaces of the pistons 5 and 7, and the positions of the delivery port 9*b* and 11 *b*, of the volumes 5000 and 7000, relative to the moving surfaces of the pistons 5 and 7, and the pressure settings of the check valves 18*a*, 16*a* and 9*a*, 11 *a*.

Figure 5:
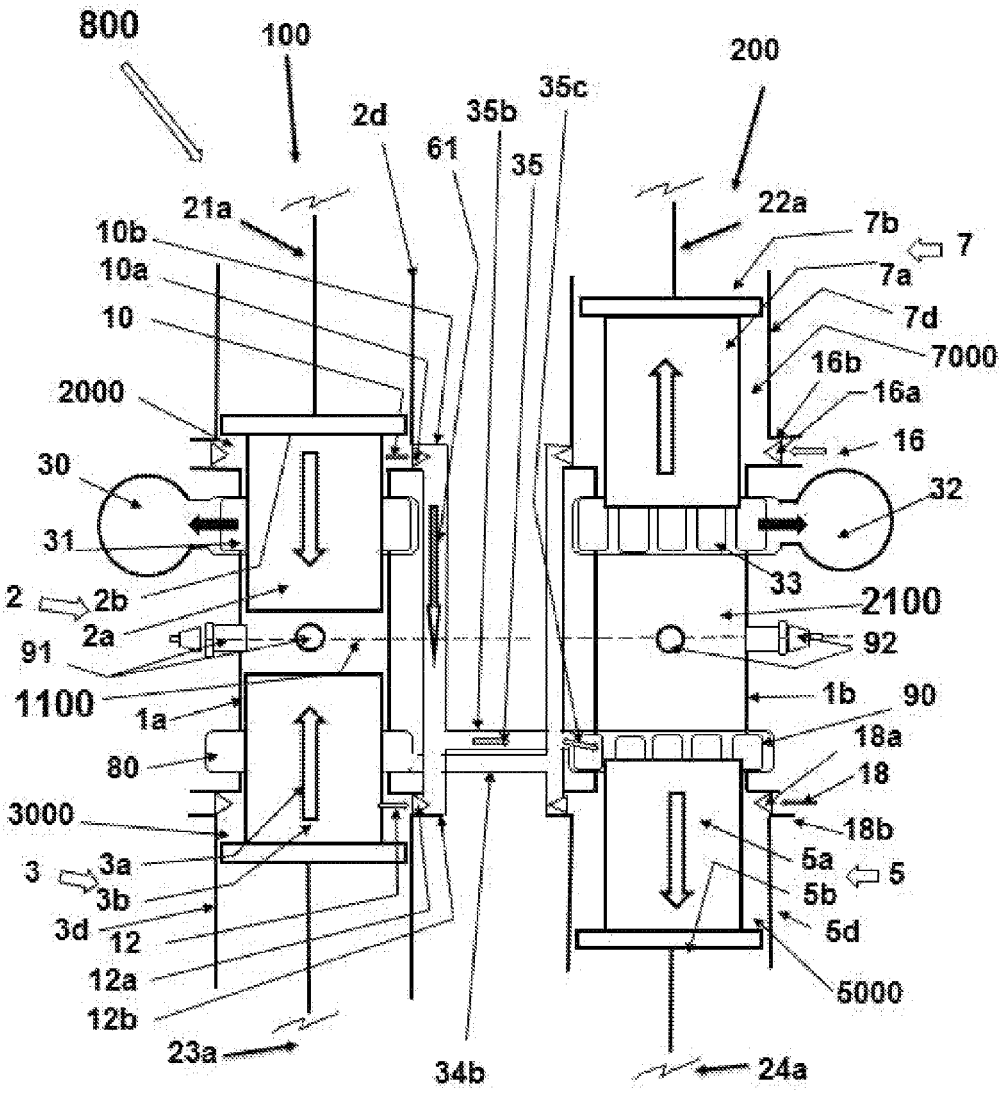
FIG. 5 shows another side view of a simplified diagrammatic arrangement of the first embodiment of a single cylinder opposed piston engine 800 with stepped pistons and a cross-over scavenge system with the stepped pistons in a second position.

With reference to FIG. 5, this is notionally the same as FIG. 2 but the crankshafts, 21, 22, 23 and 24 are not shown, and some numbering is removed to simplify the picture. FIG. 5 depicts pistons 5 and 7 moving towards their ODC positions with volume 5000, formed by the displacement of the stepped piston 5*a*/5*b* in the cylinder bore 5*d*, and volume 7000, formed by the displacement of the stepped piston 7*a*/7*b* in the cylinder bore 7*d*, both increasing and therefore sucking air from the atmosphere via the engine induction system into intake pipes 18*b* and 16*b* respectively, the said air then filling volumes 5000 and 7000. So, in FIG. 5, the stepped pistons and cylinders of cylinder 200 are engaged in recharging their air transfer volumes 5000 and 7000. Meanwhile, pistons 2 and 3 are moving towards their IDC positions, with the exhaust ports 31 and air ports 80 closed by the pistons 2 and 3. Volume 2000, formed by the displacement of the stepped piston 2*a*/2*b* in the cylinder bore 2*d*, and volume 3000, formed by the displacement of the stepped piston 3*a*/3*b* in the cylinder bore 3*d*, are both decreasing and therefore displacing air 10 and 12 into the flow conduits 10*b* and 12*b* respectively via the check valves 10*a* and 12*a*. The said air 10 and 12 collects in conduit 61, which is another part of the cross-over system, and then passes as a combined airflow 35 via the cross-over conduit 35*b*, which is a further part of the cross-over system, to the airports 90 in the cylinder liner 1*b* of cylinder 200, thereby displacing the burned gases from the previous combustion cycle in cylinder volume 2100 and to providing fresh air for the next combustion event in the volume 2100 of cylinder 200. In this way, the stepped piston scavenge pump volumes 2000 and 3000 formed by the stepped pistons 2 and 3 of cylinder 100 provide the air 35*c* to scavenge and replenish the volume 2100 of cylinder 200. Conduits 61 and 35*b* form part of the "cross-over" air transfer system, also known as the "cross-over ports" of engine 800.

Figure 6:
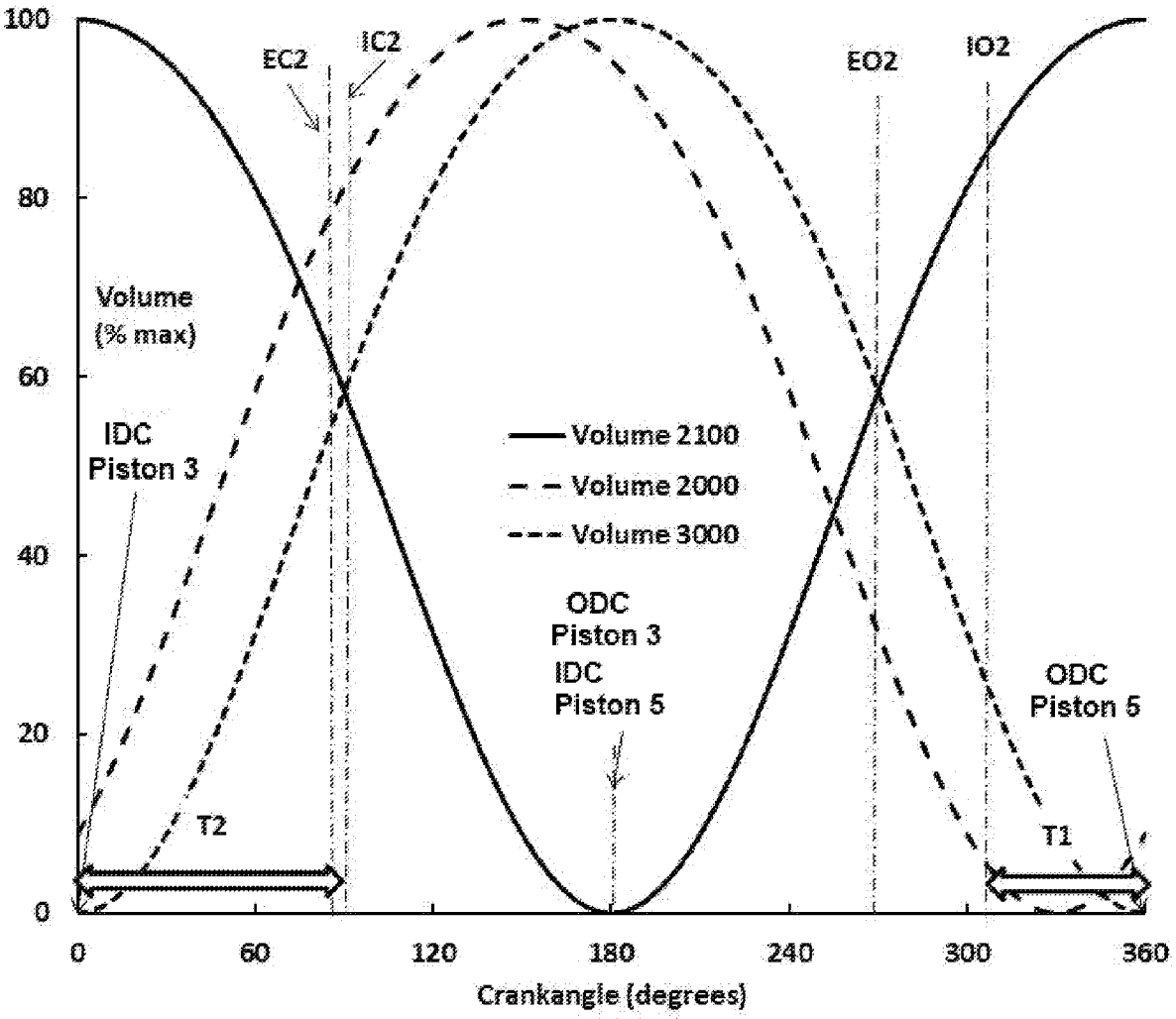
FIG. 6 is a diagram showing the approximate relative phases of the volume changes in the air transfer cylinder volumes and in the combustion cylinder volume of the engine depicted in FIG. 5.

With reference to FIG. 6, the relative phasing of the volume changes for the cylinder volume 2100 of cylinder 200, the stepped piston air transfer volume 2000 and stepped piston air transfer volume 3000 of cylinder 100 are shown versus the crankangle position of air piston 3, which is phased notionally 30° crankangle in retard of the exhaust piston 2. The exhaust port open period for cylinder 200 corresponds to the crankangle between EO2-EC2, i.e. approximately 160° crankangle duration. The airport open period for cylinder 200 corresponds to the crankangle between IO2-IC2, i.e. approximately 100° crankangle duration denoted by T1 and T2 in FIG. 6. It should be understood that piston 3 and piston 2 of cylinder 100 are phased 180° crankangle relative to piston 5 and piston 7 of cylinder 200, and this is why the ODC of piston 3 corresponds to the IDC of piston 5 and this is why the port timings EO2, EC2, IO2 and IC2, that relate to pistons 5 and 7 of cylinder 200 and volume 2100, are shown either side of the ODC of piston 5. The asymmetry of the port timings is an optional beneficial feature of opposed piston engines, and opposed stepped piston engines, and arises from the phasing of the exhaust and air pistons which in this example is notionally 30° crankangle, as previously stated. The graphs in FIG. 6 show stepped piston air transfer volumes 2000 and 3000 of cylinder 100 move in anti-phase with volume 2100 of cylinder 200 due to 180° crankangle phasing between cylinder 100 and cylinder 200. Hence volumes 2000 and 3000 are being displaced in to volume 2100 as the pistons 2 and 3 of cylinder 100 move towards their inner dead centre (FIG. 5, and IDC in FIG. 6) positions. This air transfer from the volumes 2000 and 3000 of cylinder 100 to the volume 2100 of cylinder 200 occurs during the expansion stroke of the cylinder 200 as the air ports open (IO2 in FIG. 6) after the opening of the exhaust ports (EO2 in FIG. 6), and continues to outer dead centre of pistons 5 and 7. In this way, the volume 2100 of cylinder 200 is positively scavenged with fresh air from the opening to closing of the air ports. It should be explained that in FIG. 6 the volume displacements 2100, 2000 and 3000 are all shown as having maximums of 100% notionally for simplicity and clarity. However, the absolute volumes 2100, 2000 and 3000 can all be different and adjusted by design of the selected diameters of the pistons 2 and 3 and pistons 5 and 7, and the strokes of crankshafts 21, 22, 23 and 24. The air transfer flowrates can be regulated by and the positions of the air entry ports 6*b* and 8*b* of the volumes 2000 and 3000 respectively, relative to the moving surfaces of the pistons 2 and 3, and the positions of the delivery port 10*b* and 12*b*, of the volumes 2000 and 3000, relative to the moving surfaces of the pistons 2 and 3, and the pressure settings of the check valves 6*a*, 8*a* and 10*a*, 12*a*. Together, conduit 60, conduit 34*b*, conduits 61 and conduit 35*b* form the "cross-over" air transfer system, also known as the "cross-over ports" of engine 800 and these cross-over ports in combination with the stepped pistons 2, 3, 5 and 7 form the "cross-over" stepped piston scavenging system.

The previously described cross-over stepped piston scavenging systems in FIGS. 2-6 are related to a first cylinder and a second cylinder operating with a phase angle of 180° crankangle between the two cylinders. This invention is therefore obviously suited to opposed piston engines with cylinder arrangements that can be arranged in cross scavenging pairs such as an in-line two cylinder with an even firing order, such as a "square four" cylinder which comprises two pairs of in-line two cylinder engines, and such as a vee four cylinder in which each bank has a pair of cylinders, said cylinders within each bank having a 180° crankangle firing interval between them. The orientation angle between the cylinder banks may be 45° or greater.

Figure 7:
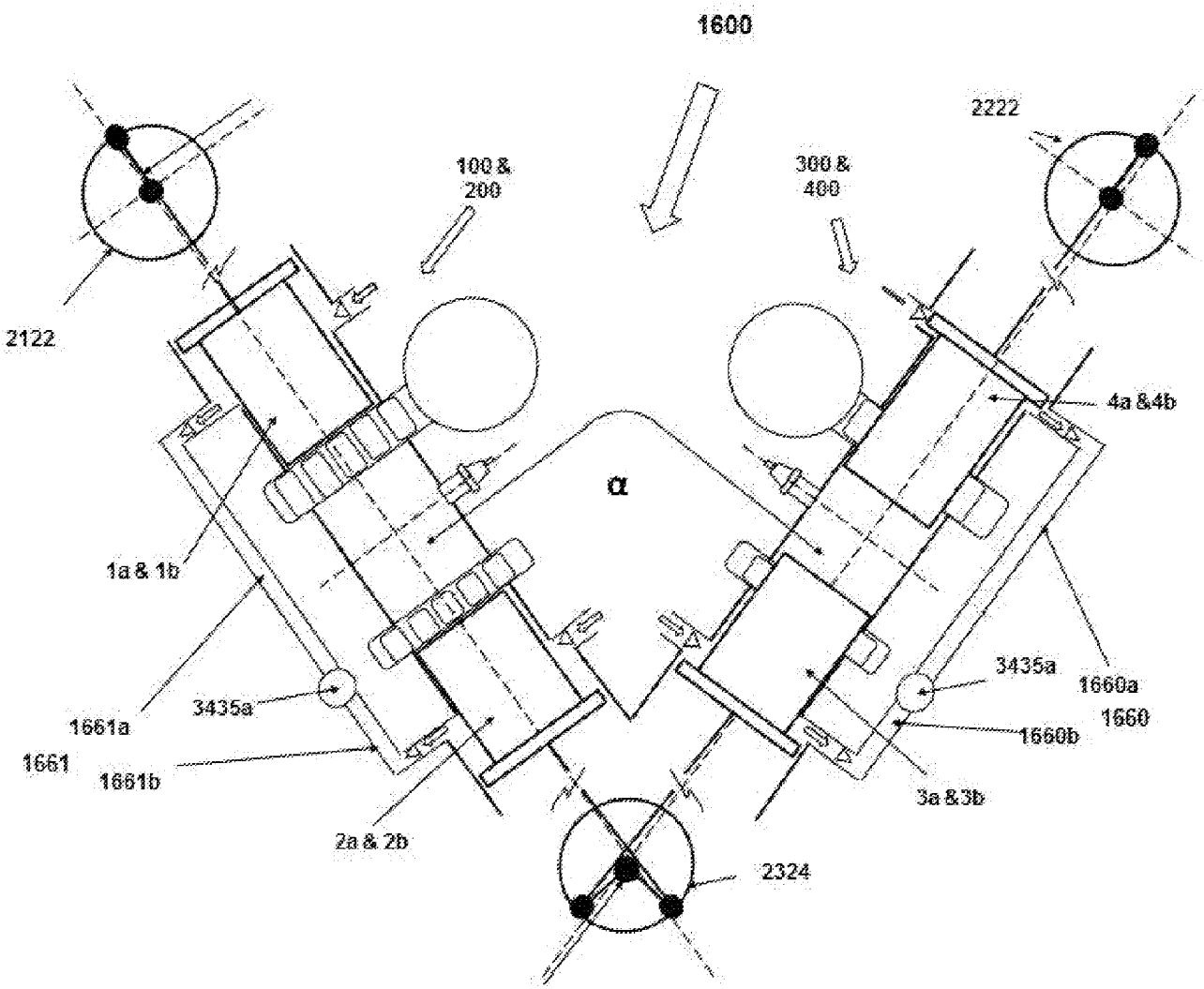
FIG. 7 is a diagram of a four cylinder opposed stepped piston engine embodiment 1600 of the invention in which the cylinders are configured in a "vee" formation.

With reference to FIG. 7, the opposed stepped piston engine 1600 of this embodiment has four cylinders arranged with 90° vee orientation, between the cylinder banks, denoted by angle α, and the shared crankshaft 2324 has only two crankthrows orientated at 180° to each other, with a first crankpin connected to a first connecting rod and piston 2*a* of the first cylinder bank, having cylinders 100 and 200, and said crankpin also connected to another first connecting rod and piston 3*a* of the second cylinder bank, having cylinders 300 and 400, and with a second crankpin, orientated at 180° to the first crankpin, and connected to a second connecting rod and piston 2*b* of the first cylinder bank and said second crankpin also connected to another second connecting rod and piston 3*b* of the second cylinder bank, the stepped opposed pistons of each cylinder 1*a* and 2*a*, and 1*b* and 2*b*, on the first bank being connected by a first cross-over stepped piston scavenging system 3435*a*, and the stepped opposed pistons of each cylinder 3*a* and 4*a*, and 3*b* and 4*b* on the second bank being connected by a second cross-over stepped piston scavenging system 3435*b*. The crankshaft 2122 driving the stepped pistons 1*a* and 1*b* is linked to crankshaft 2324 by means such as gears, chain drive, or tooth belt or eccentric rod drive, and crankshaft 2222 driving the stepped pistons 4*a* and 4*b* is linked to crankshaft 2324 by means such as gears, chain drive or tooth belt or eccentric rod drives.

Another variation of the invention shown in FIG. 7 is an opposed stepped piston four cylinder configuration arranged in a "narrow vee" format with two cylinder banks having their bank angle α at less than 45° orientation such that the cylinders 100 and 200, and 300 and 400 are merged in to a single block and the common crankshaft having four crankpins which are orientated at angles of approximately 90° plus or minus the angle between the cylinder banks, the stepped opposed pistons of each cylinder on the first bank being connected by a first cross-over stepped piston scavenging system 3435*a*, and the stepped opposed pistons of each cylinder on the second bank being connected by a second cross-over stepped piston scavenging system 3435*b*.

Figure 8:
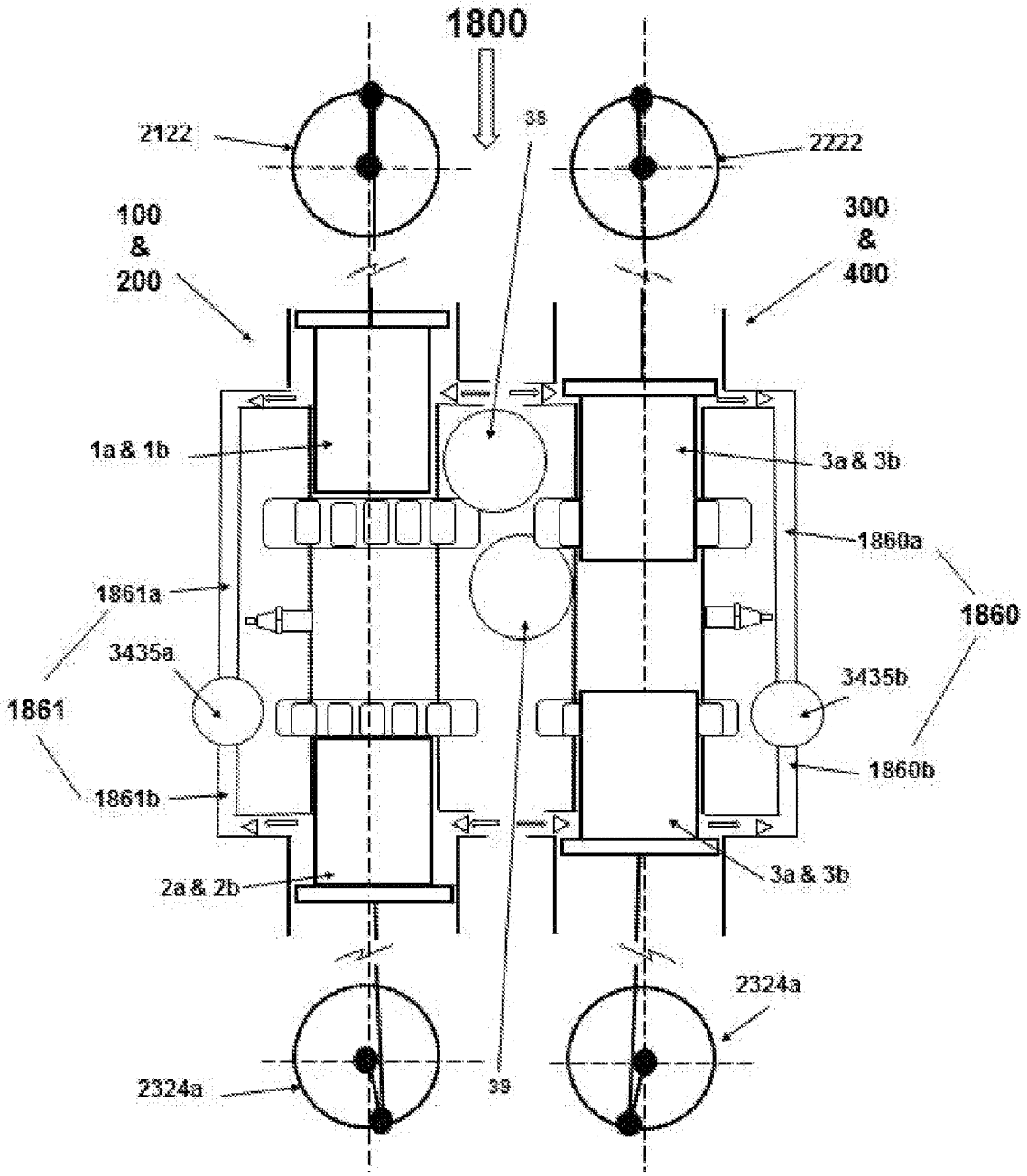
FIG. 8 is a diagram of a four cylinder opposed stepped piston engine embodiment 1800 of the invention in which the cylinders are configured in a "rectangular" formation.

With reference to FIG. 8, this example of the embodiment is an opposed stepped piston "rectangular" four cylinder configuration 1800 arranged with two parallel and adjacent cylinder banks with cylinders 100 and 200, and cylinders 300 and 400, the banks being merged in to a single cylinder barrel or cylinder block, and two pistons 2*a* and 2*b* and connecting rods of the first cylinder bank 100 and 200 being connected to a first crankshaft 2324*a* and two pistons 3*a* and 3*b* and connecting rods of the second cylinder bank 300 and 400 being connected to a second crankshaft 2324*b*, each crankshaft having two crankpins orientated at 180° to each other, and the crankshafts 2324*a* and 2324*b* being linked with a phase angle of 90° crankangle to each other by some means such as gears, chain drives or belt drives or eccentric rod drives, and the first bank with cylinders 100 and 200 having a first cross-over stepped piston scavenging system 3435*a* linking the first pair of cylinders 100 and 200, and the stepped opposed pistons of each cylinder 300 and 400 on the second bank being connected by a second cross-over stepped piston scavenging system 3435*b*.

In this rectangular four arrangement, either crankshaft 2324*a* is linked to crankshaft 2122 by means such as gears, tooth belts or chain/sprocket drives, or crankshaft 2324*b* is linked to crankshaft 2222 by means such as gears, tooth belts or chain/sprocket drives or eccentric rod drives. The exhaust receiver 38 connects the exhausts of cylinders 100 and 200 and the exhaust receiver 39 connects the exhausts of cylinders 300 and 400.

In another embodiment, the invention may be applied to opposed stepped piston engines having 120° firing intervals between cylinders. In one example of this embodiment, an in-line three cylinder engine has a first cylinder 100 which is connected to a second cylinder 200 by a first cross-over stepped piston scavenging system, and said second cylinder 200 which is connected to a third cylinder 300 by a second cross-over stepped piston scavenging system, and said third cylinder 300 which is connected to said first cylinder 100 by a third cross-over stepped piston scavenging system, the firing order for the engine being in the sequence of cylinder 100, cylinder 200 and cylinder 300 with 120° crankangle firing intervals.

In further narrow vee embodiment of the three cylinder in-line opposed stepped piston engine described in the preceding paragraph, two cylinders are arranged in a first cylinder bank and the third cylinder is arranged in a second cylinder bank, said two cylinder banks being merged in to a single block with the common crankshaft having three crankpins which are orientated at angles of approximately 120° plus or minus the angle between the cylinder banks, the stepped opposed pistons of the first and second cylinders on the first bank being connected by a first cross-over stepped piston scavenging system, and the stepped opposed piston(s) of the second cylinder on the first bank being linked by a second cross-over stepped piston scavenging system to the third cylinder which is on the second bank, the stepped opposed piston(s) of said third cylinder being linked by a third cross-over stepped piston scavenging system to the first cylinder which is on the first cylinder bank. This arrangement is very compact and enables similar lengths for all cross-over conduits.

In a further variation of opposed stepped piston engines having 120° firing intervals between cylinders, a six cylinder vee engine has two banks of cylinders, the first bank having three cylinders, 100, 200 and 300, and the second bank having three cylinders, 400, 500 and 600, the first cylinder bank being orientated at 60° to the second cylinder bank, with three pistons from cylinders 100, 200 and 300 being in connection with a common first crankshaft, and with three pistons from cylinders 400, 500 and 600 being in connection with said common first crankshaft which is connection with the other two crankshafts by means such as gears, tooth belts or chain/sprocket drives or eccentric rod drives, so that each cylinder 100, 200, 300, 400, 500 and 600 can each operate with at least one stepped piston. The first cylinder bank has a first cylinder 100 which is connected to a second cylinder 200 by a first cross-over stepped piston scavenging system, and said second cylinder 200 which is connected to a third cylinder 300 by a second cross-over stepped piston scavenging system, and said third cylinder 300 which is connected to said first cylinder 100 by a third cross-over stepped piston scavenging system, the firing order for this first cylinder bank being in the sequence of cylinder 100, cylinder 200 and cylinder 300 with 120° crankangle firing intervals. The second cylinder bank has another first cylinder 400 which is connected to another second cylinder 500 by another first cross-over stepped piston scavenging system, and said another second cylinder 500 which is connected to another third cylinder 600 by another second cross-over stepped piston scavenging system, and said another third cylinder 600 which is connected to said another first cylinder 100 by another third cross-over stepped piston scavenging system, the firing order for this second cylinder bank being in the sequence of cylinder 400, cylinder 500 and cylinder 600 with 120° crankangle firing intervals, the second cylinder bank being phased 60° to the first cylinder bank so that cylinders fire alternately between cylinder banks in a sequence of cylinder 100, cylinder 400, cylinder 200, cylinder 500, cylinder 300, cylinder 600 with 60° crankangle firing intervals.

In further narrow vee embodiment of the six cylinder vee configuration of opposed stepped piston engine described in the preceding paragraph, three cylinders 100, 200 and 300 are arranged in a first cylinder bank and three cylinders 400, 500 and 600 are arranged in a second cylinder bank with an orientation angle α which is less than 45°, said two cylinder banks being merged in to a single block with the common crankshaft having six crankpins which are orientated at angles of approximately 60° plus or minus the orientation angle between the cylinder banks which is designated as α as shown in FIG. 7. The first cylinder bank has a first cylinder 100 which is connected to a second cylinder 200 by a first cross-over stepped piston scavenging system, and said second cylinder 200 which is connected to a third cylinder 300 by a second cross-over stepped piston scavenging system, and said third cylinder 300 which is connected to said first cylinder 100 by a third cross-over stepped piston scavenging system, the firing order for this first cylinder bank being in the sequence of cylinder 100, cylinder 200 and cylinder 300 with 120° crankangle firing intervals. The second cylinder bank has another first cylinder 400 which is connected to another second cylinder 500 by another first cross-over stepped piston scavenging system, and said another second cylinder 500 which is connected to another third cylinder 600 by another second cross-over stepped piston scavenging system, and said another third cylinder 600 which is connected to said another first cylinder 100 by another third cross-over stepped piston scavenging system, the firing order for this second cylinder bank being in the sequence of cylinder 400, cylinder 500 and cylinder 600 with 120° crankangle firing intervals, the second cylinder bank being orientated at a to the first cylinder bank so that cylinders fire alternately between cylinder banks in a sequence of cylinder 100, cylinder 400, cylinder 200, cylinder 500, cylinder 300, cylinder 600 with 60° crankangle firing intervals. This arrangement is very compact and enables similar lengths for all cross-over conduits.

A further embodiment of the invention in six cylinder engines is an opposed stepped piston "rectangular" six cylinder configuration arranged, with two parallel and adjacent cylinder banks, notionally similar to that shown in FIG. 8, with cylinders 100, 200 and 300 in the first cylinder bank, and with cylinders 400, 500 and 600 in the second cylinder bank, the banks being merged in to a single cylinder barrel or cylinder block, and three pistons and their connecting rods of the first cylinder bank 100, 200 and 300 being connected to a first crankshaft and three pistons and their connecting rods of the second cylinder bank 400, 500 and 600 being connected to a second crankshaft, each crankshaft having three crankpins orientated at 120° to each other, and the two crankshafts being linked with a phase angle of 60° crankangle to each other by some means such as gears, chain drives or belt drives or eccentric rod drives, and the first cylinder bank with cylinders 100, 200 and 300 having a first cross-over stepped piston scavenging system linking cylinders 100 and 200, and having a second cross-over stepped piston scavenging system linking cylinders 200 and 300, and having a third cross-over stepped piston scavenging system linking cylinders 300 and 100, and the second cylinder bank with cylinders 400, 500 and 600 having another first cross-over stepped piston scavenging system linking cylinders 400 and 500, and having another second cross-over stepped piston scavenging system linking cylinders 500 and 600, and having another third cross-over stepped piston scavenging system linking cylinders 600 and 400, so that cylinders fire alternately between cylinder banks in a sequence of cylinder 100, cylinder 400, cylinder 200, cylinder 500, cylinder 300, cylinder 600 with 60° crankangle firing intervals.

Further advantages of the stepped piston scavenging in comparison to other scavenging systems are that it can be well matched to the engine combustion airflow requirements over the engine speed range and especially at low speeds, and it is compact, simple, reliable and cost effective versus external scavenge pumps.

The previously described engines may operate with compression ignition combustion, or with spark ignition combustion, or with a liquid or gaseous fuel ignited by a small amount readily auto-igniting fuel such as 38-98 cetane diesel fuel. All these engine types may be operated in naturally aspirated or pressure charged mode. The previously described engines may be equipped with the appropriate means for fuelling the cylinders and have ignition systems if required. Fuelling may be direct in to the combustion chambers in the cylinders, or indirect into pre-combustion chambers, or into the conduits leading to the air ports, or into the air ports.

Features of preferred embodiments of the invention are set out in the following clauses:

1 An opposed stepped piston engine 800 comprising: At least a first cylinder 100 with a volume 1100 having a cylinder bore 1*a* connected to at least a first stepped cylinder bore 2*d* at one end of the cylinder bore 1*a*, said cylinder bore 1*a* having exhaust ports 31 at one end of cylinder bore 1*a* and having air ports 80 at the other end of cylinder bore 1*a*, said exhaust ports 31 being in connection with an exhaust receiver 30, and said air ports 80 being in connection with cross-over conduits 34*b* and 60 from a second cylinder 200, At least a first stepped piston 2*a*/2*b* operating respectively in cylinder bores 1*a* and 2*d* and controlling either the exhaust ports 31 or the air ports 80, said stepped piston 2*a*/2*b* being linked by a connecting rod 21*a* to a crankshaft 21, At least a first piston 3 operating in cylinder bore 1*a* and controlling either the exhaust ports 31 or the air ports 80, said piston 3 being linked by a connecting rod 23*a* to a crankshaft 23, At least a first air inlet conduit 6*b* to the air transfer volume 2000 formed by the stepped piston 2*a*/2*b* and the cylinder bores 1*a* and 2*d*. Optionally the engine includes a check valve 6*a* to ensure air flow only into the volume 2000 from conduit 6*b*, at least a first air delivery conduit 10*b* from the air transfer volume 2000, formed by the stepped piston 2*a*/2*b* and the cylinder bores 1*a* and 2*d*, and connecting with a receiver conduit 61 which is in connection with the cross-over conduit 35*b*. Optionally the engine includes a check valve 10*a* to ensure flow only from the volume 2000 to conduit 10*b*, an airflow connection between cross-over conduit 35*b* and air ports 90 of cylinder 200, means 91 for ignition and fuelling in the volume 1100, at least a second cylinder 200 with a volume 2100 having a cylinder bore 1*b* connected to at least another first stepped cylinder bore 7*d* at one end of the cylinder bore 1*b*, said cylinder bore 1*b* having exhaust ports 33 at one end of cylinder bore 1*b* and having air ports 90 at the other end of cylinder bore 1*b*, said exhaust ports 33 being in connection with an exhaust receiver 32, and said air ports 90 being in connection with cross-over conduit 35*b* and 61 from a first cylinder 100; at least another first stepped piston 7*a*/7*b* operating respectively in cylinder bores 1*b* and 7*d* and controlling either the exhaust ports 33 or the air ports 90, said stepped piston 7*a*/7*b* being linked by a connecting rod 22*a* to a crankshaft 22, at least another first piston 5 operating in cylinder bore 1*b* and controlling either the exhaust ports 33 or the air ports 90, said piston 3 being linked by a connecting rod 24*a* to a crankshaft 24, at least a first air inlet conduit 16*b* to the air transfer volume 7000 formed by the stepped piston 7*a*/7*b* and the cylinder bores 1*b* and 7*d*. Optionally the engine includes a check valve 16*a* to ensure air flow only into the volume 7000 from conduit 16*b*, at least a first air delivery conduit 11*b* from the air transfer volume 7000, formed by the stepped piston 7*a*/7*b* and the cylinder bores 1*b* and 7*d*, and connecting with a receiver conduit 60 which is in connection with the cross-over conduit 34*b*. Optionally the engine includes a check valve 11*a* to ensure flow only from the volume 7000 to conduit 11*b*, an airflow connection between cross-over conduit 34*b* and air ports 80 of cylinder 100, means 92 for ignition and fuelling in the volume 2100, a solid connection between crankshafts 21 and 22, a solid connection between crankshafts 23 and 24, and either means such as gears, belt drives, chain drives or eccentric rod drives for linking crankshafts 21 and 23 or means for linking crankshafts 22 and 24.

2 An engine as in Clause 1, in which the cylinder bore 1*a* of cylinder 100 is also connected to a second stepped cylinder bore 3*d* at the other end of the cylinder bore 1*a*, arranged for a second stepped piston 3*a*/3*b* which controls either the exhaust ports 31 or the air ports 80, said piston 3*a*/3*b* being linked by a connecting rod 23*a* to a crankshaft 23, and said piston in combination with cylinder bores 1*a* and 3*d* forming an air transfer volume 3000 which is in connection with the engine induction system via air conduit 8*b*, with an optional check valve 8*a* to ensure flow only to the volume 3000, and said volume 3000 having also a conduit 12*b*, with an optional check valve 12*a* to ensure flow only from the volume 3000, which is in connection with receiver conduit 61 and cross-over conduit 35*b* leading to the air ports 90 of the cylinder 200.

3 An engine as in Clause 1-2, in which the cylinder bore 1*b* of cylinder 200 is also connected to another second stepped cylinder bore 5*d* at the other end of the cylinder bore 1*b*, arranged for a another second stepped piston 5*a*/5*b* which controls either the exhaust ports 33 or the air ports 90, said piston 5*a*/5*b* being linked by a connecting rod 24*a* to a crankshaft 24, and said piston in combination with cylinder bores 1*b* and 5*d* forming an air transfer volume 5000 which is in connection with the engine induction system via air conduit 18*b*, with an optional check valve 18*a* to ensure flow only to the volume 5000, and said volume 5000 having also a conduit 9*b*, with an optional check valve 9*a* to ensure flow only from the volume 5000, which is in connection with receiver conduit 60 and cross-over conduit 34*b* leading to the air ports 80 of the cylinder 100.

4 An opposed piston engine 800, as in Clauses 1-3, in which at least a first piston 2 of the first cylinder 100 is arranged as a first stepped piston 2*a*/2*b* in a first stepped cylinder bore 2*d* to provide some or all of the engine airflow requirements for a second cylinder 200, and in which at least another first piston 7 of said second cylinder 200 is arranged as a stepped piston 7*a*/7*b* in another first stepped cylinder bore 7*d* to provide some or all of the engine airflow requirements for said first cylinder 100.

5 An opposed piston engine 800, as in Clauses 1-4, in which at least a second piston 3 of the first cylinder 100 is arranged as a second stepped piston 3*a*/3*b* in a second stepped cylinder bore 3*d* to provide some or all of the engine airflow requirements for a second cylinder 200, and in which at least another second piston 5 of said second cylinder 200 is arranged as a stepped piston 5*a*/5*b* in another second stepped cylinder bore 5*d* to provide some or all of the engine airflow requirements for said first cylinder 100.

6 An engine, as in Clauses 1-5, in which the stepped air transfer piston 2*b* of cylinder 100 moves substantially out of phase with the pistons 5 and 7 of the second cylinder 200, and in which the stepped air transfer piston 7*b* of cylinder 200 moves substantially out of phase with the pistons 2 and 3 of the first cylinder 200.

7 An engine 800, as in Clauses 1-6, in which the stepped piston scavenge pump volumes 2000 and 3000 formed by the stepped pistons 2 and 3 of cylinder 100 provide the air 35*c* to scavenge and replenish the volume 2100 of cylinder 200, with conduits 61 and 35*b* forming a second part of the "cross-over" air transfer system of the engine, and the stepped piston scavenge pump volumes 5000 and 7000 formed by the stepped pistons 5 and 7 of cylinder 200 provide the air 34*c* to scavenge and replenish the volume 1100 of cylinder 100, with conduits 60 and 34*b* forming a first part of the "cross-over" air transfer system of the engine, and together the first and second parts of the cross-over air transfer system comprise the "cross-over" air transfer system, also known as the "cross-over ports" of engine 800 and these cross-over ports in combination with the stepped pistons 2, 3, 5 and 7 form the cross-over stepped piston scavenging system.

8 An engine, as in Clauses 1-7 with at least a first cylinder and at least asecond cylinder operating with a phase angle of 180° crankangle between the two cylinders.

9 An engine as in Clause 8, which is an in-line two cylinder engine wherein cylinders 100 and 200 have a 180° crankangle firing interval between them.

10 An engine 1600 as in Clause 8, which is of a vee four cylinder configuration in which cylinders 100 and 200 of a first cylinder bank have a 180' crankangle firing interval between them and cylinders 300 and 400 of a second cylinder bank have a 180° crankangle firing interval between them, and said cylinders 300 and 400 having a 90° crankangle phase angle with cylinders 100 and 200, in which cylinders 100 and 200 are linked by a first cross-over scavenge system, and cylinders 300 and 400 are linked by a second cross-over scavenge system.

11 An engine as in Clause 10, which is of a narrow vee four cylinder configuration.

12 An engine as in Clause 8, which is an opposed stepped piston "rectangular" four cylinder configuration 1800 arranged with two parallel and adjacent cylinder banks with cylinders 100 and 200 in the first cylinder bank, and with cylinders 300 and 400 in the second cylinder bank, the banks being merged in to a single cylinder barrel or cylinder block, and two pistons 2*a* and 2*b* and connecting rods of the first cylinder bank 100 and 200 being connected to a first crankshaft 2324*a* and two pistons 3*a* and 3*b* and connecting rods of the second cylinder bank 300 and 400 being connected to a second crankshaft 2324*b*, each crankshaft having two crankpins orientated at 180° to each offer, and the crankshafts 2324*a* and 2324*b* being linked with a phase angle of 90° crankangle b each other by some means such as gears, chain drives or belt drives or eccentric rod drives, and the first cylinder bank with cylinders 100 and 200 being connected by a first cross-over stepped piston scavenging system 3435*a*, and the stepped opposed pistons of each cylinder 300 and 400 on the second cylinder bank with cylinders being connected by a second cross-over stepped piston scavenging system 3435*b*.

13 An engine as in Clauses 1-7 with at least a first cylinder and at least a second cylinder operating with a phase angle of 120° crankangle between the two cylinders.

14 An engine as in Clause 13, which is of an opposed stepped piston in-line three cylinder configuration having a first cylinder 100 which is connected to a second cylinder 200 by a first cross-over stepped piston scavenging system, and said second cylinder 200 which is connected to a third cylinder 300 by a second cross-over stepped piston scavenging system, and said third cylinder 300 which is connected to said first cylinder 100 by a third cross-over stepped piston scavenging system, the firing order for the engine being in the sequence of cylinder 100, cylinder 200 and cylinder 300 with 120° crankangle firing intervals.

15 An engine as in Clause 13 which is of an opposed stepped piston narrow vee three cylinder configuration having two cylinders arranged in a first cylinder bank and the third cylinder is arranged in a second cylinder bank, said two cylinder banks being merged in to a single cylinder block with the common crankshaft having three crankpins which are orientated at angles of approximately 120° plus or minus the angle between the cylinder banks, the stepped opposed pistons of the first and second cylinders on the first cylinder bank being connected by a first cross-over stepped piston scavenging system, and the stepped opposed piston(s) of the second cylinder on the first cylinder bank being linked by a second cross-over stepped piston scavenging system to the third cylinder which is on the second cylinder bank, the stepped opposed piston(s) of said third cylinder being linked by a third cross-over stepped piston scavenging system to the first cylinder which is on the first cylinder bank.

16 An engine as in Clause 13 which is an opposed piston six cylinder vee configuration having two banks of cylinders, the first bank having three cylinders, 100, 200 and 300, and the second bank having three cylinders, 400, 500 and 600, the first cylinder bank being orientated at 60° to the second cylinder banK with three pistons from cylinders 100, 200 and 300 being in connection with a common first crankshaft, and with three pistons from cylinders 400, 500 and 600 being in connection with said common first crankshaft which is connection with the other two crankshafts by means such as gears, tooth belts or chain/sprocket drives, so that each cylinder 100, 200, 300, 400, 500 and 600 can operate with at least one stepped piston, wherein the first cylinder bank has a first cylinder 100 which is connected to a second cylinder 200 by a first cross-over stepped piston scavenging system, and said second cylinder 200 which is connected to a third cylinder 300 by a second cross- over stepped piston scavenging system, and said third cylinder 300 which is connected to said first cylinder 100 by a third cross-over stepped piston scavenging system, the firing order for this first cylinder bank being in the sequence of cylinder 100, cylinder 200 and cylinder 300 with 120° crankangle firing intervals and wherein be second cylinder bank has another first cylinder 400 which is connected to another second cylinder 500 by another first cross-over stepped piston scavenging system, and said another second cylinder 500 which is connected to another third cylinder 600 by another second cross-over stepped piston scavenging system, and said another third cylinder 600 which is connected to said another first cylinder 100 by another third cross-over stepped piston scavenging system, the firing order for this second cylinder bank being in the sequence of cylinder 400, cylinder 500 and cylinder 600 with 120° crankangle firing intervals, the second cylinder bank being phased 60° to the first cylinder bank so that cylinders fire alternately between cylinder banks in a sequence of cylinder 100, cylinder 400, cylinder 200, cylinder 500, cylinder 300, cylinder 600 with 60° crankangle firing intervals.

17 An engine as in Clause 13 which is an opposed piston six cylinder narrow vee configuration wherein three cylinders 100, 200 and 300 are arranged in a first cylinder bank and three cylinders 400, 500 and 600 are arranged in a second cylinder bank, said two cylinder banks being merged in to a single cylinder block with the common crankshaft having six crankpins which are orientated at angles of approximately 60° plus or minus the orientation angle a between the cylinder banks, said first cylinder bank having a first cylinder 100 which is connected to a second cylinder 200 by a first cross-over stepped piston scavenging system, and said second cylinder 200 which is connected to a third cylinder 300 by a second cross-over stepped piston scavenging system, and said third cylinder 300 which is connected to said first cylinder 100 by a third cross-over stepped piston scavenging system, the firing order for this first cylinder bank being in the sequence of cylinder 100, cylinder 200 and cylinder 300 with 120° crankangle firing intervals, and wherein said second cylinder bank has another first cylinder 400 which is connected to another second cylinder 500 by another first cross-over stepped piston scavenging system, and said another second cylinder 500 which is connected to another third cylinder 600 by another second cross-over stepped piston scavenging system, and said another third cylinder 600 which is connected to said another first cylinder 100 by another third cross-over stepped piston scavenging system, the firing order for this second cylinder bank being in the sequence of cylinder 400, cylinder 500 and cylinder 600 with 120° crankangle firing intervals, so that cylinders fire alternately between cylinder first and second banks in a sequence of cylinder 100, cylinder 400, cylinder 200, cylinder 500, cylinder 300, cylinder 600 with 60° crankangle firing intervals.

18 An engine as in Clause 13, which is an opposed stepped piston "rectangular" six cylinder configuration arranged with two parallel and adjacent cylinder banks with cylinders 100, 200 and 300 in the first cylinder bank, and with cylinders 400,500 and 600 in the second cylinder bank, the banks being merged in to a single cylinder barrel or cylinder block, and three pistons and their connecting rods of the first cylinder bank 100, 200 and 300 being connected to a first crankshaft and three pistons and their connecting rods of the second cylinder bank 400, 500 and 600 being connected to a second crankshaft, each crankshaft having three crankpins orientated at 120° to each other, and the two crankshafts being linked with a phase angle of 60° crankangle b each other by some means such as gears, chain drives or belt drives, and the first cylinder bank with cylinders 100, 200 and 300 having a first cross-over stepped piston scavenging system linking cylinders 100 and 200, and having a second cross-over stepped piston scavenging system linking cylinders 200 and 300, and having a third cross-over stepped piston scavenging system linking cylinders 300 and 100, and the second cylinder bank with cylinders 400, 500 and 600 having another first cross-over stepped piston scavenging system linking cylinders 400 and 500, and having another second cross-over stepped piston scavenging system linking cylinders 500 and 600, and having another third cross-over stepped piston scavenging system linking cylinders 600 and 400.

19 Opposed stepped piston engines as in Clauses 1-18 which operate with compression ignition combustion.

20 Opposed stepped piston engines as in Clauses 1-18 which operate with spark ignition combustion.

21 Opposed stepped piston engines as in Clauses 1-20 which operate with a 10 liquid or gaseous fuel ignited by a small amount auto-igniting fuel.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An opposed stepped piston two-stroke engine comprising at least a first and a second cylinder, each cylinder providing:

an air port for intake of air into a combustion volume within the cylinder, an exhaust port for exhausting gases from the combustion volume, and an air piston and an exhaust piston which are adapted to compress and expand the combustion volume by each moving between respective compression and expansion positions, such that the air piston controls the air port and the exhaust piston controls the exhaust port by opening and closing the respective ports, a drive system operable to drive the air piston and exhaust piston between their respective compression and expansion positions, the drive system comprising a pair of crankshafts configured to drive the air piston and exhaust piston at a predetermined phase angle relative to one another, a fuelling assembly for providing fuel to the combustion volume, and an ignition assembly for providing ignition within the combustion volume;

wherein the air piston is a stepped piston providing a first air transfer piston that expands and compresses a first air transfer volume to deliver air from the first air transfer volume to an air transfer system, and the exhaust piston is a stepped piston providing a second air transfer piston that expands and compresses a second air transfer volume to deliver air from the second air transfer volume to the air transfer system, each of the first and second air transfer volumes having an air inlet for receiving air;

and wherein the air transfer system provides:

fluid connection between the respective first air transfer volume of each cylinder and the air port of another respective cylinder, via respective first air transfer conduits, and fluid connection between the respective second air transfer volume of each cylinder and the air port of the other respective cylinder, via respective second air transfer conduits, wherein the drive system is configured, for each cylinder, to have a predetermined phase angle such that the exhaust piston is driven before the air piston, and the length of the passage forming the second air transfer conduit is longer than the length of passage forming the first air transfer conduit, so that as the exhaust piston moves towards its combustion position causing the second air transfer volume to be compressed, air is delivered from the second air transfer volume to the air transfer system, prior to movement of the air piston towards its combustion position causing the first air transfer volume to be compressed and air to be delivered from the first air transfer volume to the air transfer system.

2. An engine according to claim 1, wherein the air transfer system provides fluid connection between each of the respective first and second air transfer volumes of the first cylinder and the air port of the second cylinder.

3. An engine according to claim 1, wherein each stepped cylinder defines a volume having a cylinder bore portion connected to at least a first stepped cylinder bore at one end of the cylinder bore, the first stepped cylinder bore having a larger diameter than the cylinder bore, said cylinder bore providing the exhaust port towards a first end, and providing the air port towards its other end, said exhaust port being in connection with an exhaust receiver, and said air port being in connection with the air transfer system.

4. An engine according to claim 1, wherein the crankshafts are rotatably linked to one another using an eccentric rod.

5. An engine according to claim 1, wherein each air inlet includes a check valve to prevent backflow of air through the inlet.

6. An engine according to claim 1, configured to operate using compression ignition combustion.

7. An engine according to claim 1, configured to operate using spark ignition combustion.

8. An engine according to claim 1, configured to operate using a liquid or gaseous fuel ignited by a small amount auto-igniting fuel.

9. An engine according to claim 1, wherein the drive systems of the first cylinder and second cylinder are configured to operate with a phase angle of 180° crankangle between them.

10. An engine according to claim 9, wherein the engine is an in-line two cylinder engine wherein the first and second cylinders have a 180° crankangle firing interval between them.

11. An engine as claimed in claim 9, which is an opposed stepped piston four cylinder engine assembly in rectangular configuration, with two parallel and adjacent cylinder banks with first and second cylinders in the first cylinder bank, and with third and fourth cylinders in the second cylinder bank, the banks being merged into a single cylinder barrel or cylinder block, and the pistons of the first cylinder bank being driven by a first crankshaft and the pistons of the second cylinder bank being drive by a second crankshaft, each crankshaft having two crankpins orientated at 180° to each other, and the crankshafts being linked with a phase angle of 90° crankangle to each other by a linking mechanism being one of gears, chain drives, belt drives or eccentric rod drives, and the first cylinder bank being connected by a first air transfer system, and the second cylinder bank being connected by a second air transfer system.

12. An engine according to claim 1, comprising a third and a fourth cylinder in a vee configuration, in which the first and second cylinders of a first cylinder bank have a 180° crankangle firing interval between them and the third and fourth cylinders of a second cylinder bank have a 180° crankangle firing interval between them, wherein the third and fourth cylinders have a 90° crankangle phase angle with the first and second cylinders, in which the first and second cylinders are linked by a first air transfer system, and the third and fourth cylinders are linked by a second air transfer system.

13. An engine according to claim 1 having at least a first cylinder and at least a second cylinder operating with a phase angle of 120° crankangle between the two cylinders.

14. An engine according to claim 13, configured as an in-line three cylinder engine having a first cylinder which is connected to a second cylinder by a first air transfer system, and the second cylinder is connected to a third cylinder by a second air transfer system, and the third cylinder is connected to the first cylinder by a third air transfer system, the firing order for the engine being in the sequence of the first, second and then third cylinders with 120° crankangle firing intervals between each.

* * * * *